United States Patent [19]

Hannigan

[11] 4,273,284

[45] Jun. 16, 1981

[54] INSULATED RAIL JOINT

[75] Inventor: Thomas N. Hannigan, Chicago, Ill.

[73] Assignee: Portec, Inc., Oak Brook, Ill.

[21] Appl. No.: 926,968

[22] Filed: Jul. 21, 1978

[51] Int. Cl.[3] ..... E01B 11/54; E01B 11/10

[52] U.S. Cl. ..... 238/160; 238/152; 238/243

[58] Field of Search ..... 238/152-161, 238/243, 244, 283

[56] References Cited

U.S. PATENT DOCUMENTS

| | | | |
|---|---|---|---|
| 2,066,797 | 1/1937 | Oettinger | 238/160 |
| 2,315,444 | 3/1943 | Meade | 238/155 |
| 3,344,990 | 10/1967 | Bingmann et al. | 238/159 |
| 3,416,728 | 12/1968 | Hamilton, Jr. | 238/152 |
| 3,581,990 | 6/1971 | Kirik | 238/283 |

FOREIGN PATENT DOCUMENTS

| | | | |
|---|---|---|---|
| 1211567 | 3/1960 | France | 238/283 |
| 860209 | 2/1961 | United Kingdom | 238/283 |

*Primary Examiner*—Randolph A. Reese

*Attorney, Agent, or Firm*—Emory L. Groff, Jr.

[57] ABSTRACT

A rail joint includes an insulative base piece formed of a synthetic plastic composition and insertable between a rail base flange and a joint bar. The opposite surfaces of the base piece are provided with elevated ribs or serrations extending longitudinally of the length of the base piece which base piece is at least as long as the joint bar. Longitudinal migration of the base piece during travel over the rail joint is resisted and thus retention of the base piece is enhanced, due to the deformation of the ribs as the base piece is sandwiched between the rail and joint bar and irregularities in the opposed joint bar and rail base surfaces are filled by the compressed and deformed ribs.

5 Claims, 3 Drawing Figures

INSULATED RAIL JOINT

This invention relates generally to rail joints and more particularly, to an improved insulated rail joint including an insulative base member provided with means to enhance retention and thus preclude migration of the base member during passage of rail traffic over the joint.

The present invention is especially adapted for use in an insulated rail joint wherein joint bars of the chair type are employed. Examples of such an insulated rail joint are found in the patents of Thomson, U.S. Pat. No. 1,315,690 dated Sept. 9, 1919 and Hamilton, U.S. Pat. No. 3,416,728 dated Dec. 17, 1968. In providing insulative inserts for use in such rail joints, the state of the art has progressed to such a point that superior compositions are now available in the form of synthetic resinous compounds such that little problem exists insofar as deterioration or lack of dimenisonal stability during the use of such inserts. However, experience has shown that regardless of the composition of the insulative inserts, the cumulative effect of rail traffic passing over such a rail joint invariably produces a migration or creeping displacement of the insulative inserts in a longitudinal direction with one end of the insert eventually disappearing from view between one end of the joint bar and the juxtaposed rail base flange while the other end of the insert travels progressively away from the opposite end of the joint bar with the ultimate effect that the insulative integrity of the assembled joint is compromised.

By the present invention an improved insulated rail joint is provided wherein an insulative insert or base piece constructed of synthetic compositon is adapted to be inserted intermediate a rail base flange and the foot portion of a joint bar and includes on opposite surfaces of the base piece a plurality of projecting ribs or serrations extending longitudinally of the base piece which is as long as the joint bar. As the base piece is installed and becomes sandwiched between the rail and joint bar the ribs are compressed and deformed against the force of the inherent resilience of the base piece composition with the result that the contacting surface of the ribs fills irregularities existing between the rail and joint bar whereupon the base piece is precluded from longitudinal migration in either direction during subsequent rail travel over the joint assembly.

Accordingly, one of the primary objects of the present invention is to provide an improved insulated rail joint including an insulative base piece of synthetic composition disposed intermediate a rail base flange and joint bar and including a plurality of longitudinally extending ribs projecting from both surfaces of the base piece.

A further object of the present invention is to provide an improved insulated rail joint including an insulative base piece of synthetic plastic composition having a plurality of longitudinally extending elevated compressible ribs which when sandwiched between a rail and joint bar are deformed to provide transversely spaced apart areas of contact between the base piece and adjacent rail and joint bar.

Still another object of the present invention is to provide an improved insulated rail joint including an insulative base piece of synthetic plastic composition having a plurality of longitudinally extending ribs projecting beyond both surfaces of a central web with at least selected ribs on one surface staggered relative the ribs on the other surface.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawing in which.

Similar reference characters designate corresponding parts throughout the several figures of the drawing.

Figure 1:
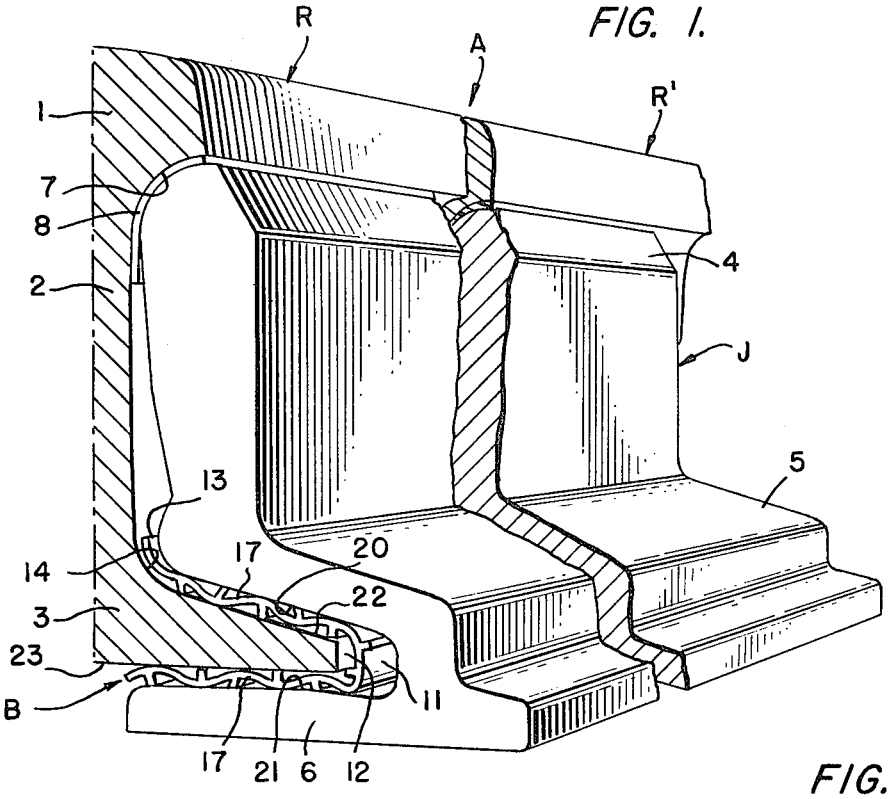
FIG. 1 is a fragmentary perspective view, partly in section, of an insulated rail joint according to the present invention.
Figure 2:
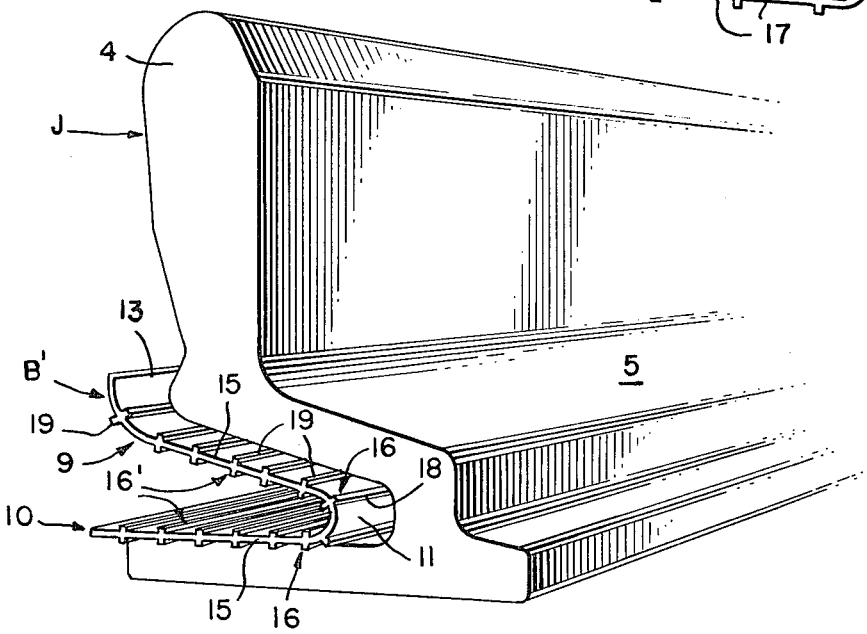
FIG. 2 is a perspective view illustrating a joint bar with an alternative base piece.

Referring now to the drawing, particularly FIGS. 1 and 2, the present invention will be seen to relate to an insulated rail joint assembly, generally designated A and which includes a pair of longitudinally aligned rails R and R′ with each rail section including the usual head 1, web 2 and base flange 3. Joining the two rail sections R and R′ is a joint bar J disposed adjacent each rail web 2 and having a head or upright 4 and foot 5 provided with the base 6 spaced therebeneath. As is well known in the art, the joint bar head 4 is adapted to be disposed within the head fillet 7 of the rail and is electrically isolated therefrom by means of a suitable insulative head piece 8 while the rail base flange 3 is disposed within the throat defined between the joint bar foot 5 and base 6.

The foot and base of the joint bar are electrically isolated from the base flange 3 of the rail by means of the insert or base piece B comprising a substantially V-shaped imperforate member constructed of any suitable well known insulative composition possessing a limited degree of resilience, such as synthetic resin. The base piece B includes an upper arm 9 disposed atop the rail base flange 3 and a lower arm 10 disposed beneath the tapered rail base flange 3, which latter is joined to the former by means of the end wall 11. The lower arm 10 extends from a point substantially adjacent the vertical center axis of the rail web 2 while the upper arm 9 will be seen to extend inwardly from the end wall 11 and terminates in a curved base fillet section 13 engageable with the base fillet 14 of the rail.

As will be readily appreciated by those skilled in the rail appliance art, the structure illustrated in FIG. 1 of the drawing quite obviously is duplicated on the other side of the rail web centerline and for purposes of clarity only one set of the involved components are shown. Likewise, the illustration of the conventional joint bolts, bolt holes and end post intermediate the two rail sections are omitted as these components form no part of the present invention.

The base pieces B and B′ are both constructed to provide a central body or web 15 which itself is preferably of consistent thickness throughout and from which extends, on either surface thereof, a plurality of ribs or serrations, generally designated 16–16′. The ribs 16 project outwardly from the arms 9 and 10 while the ribs 16′ extend inwardly from the two arms. The ribs all extend longitudinally of the base piece B which latter is at least as long as the joint bar J and as will be most clearly seen in FIG. 3 of the drawing, the ribs are transversely or laterally spaced-apart from one another to provide a groove 17 intermediate each pair of adjacent ribs. For ease of manufacture and uniformity of assembly, the ribs 16–16' are preferably equi-spaced from one another and parallel to the running length of the base piece.

Figure 3:
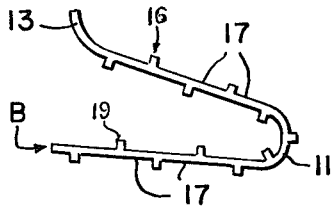
FIG. 3 is an end elevation of the base piece of FIG. 1 as it appears before installation and deformation.

The distinction between the two embodiments illustrated in FIGS. 1 and 2 will be readily apparent from a comparison of these views of the drawing. The base piece B of FIG. 1 will be seen to include inside ribs 16' disposed in an offset or staggered relationship with respect to the outside ribs 16 while the two sets of ribs 16–16' in the base piece B' of FIG. 2 are oppositely disposed from one another. In either instance, each rib includes a pair of side walls 18—18 radiating outwardly from the respective surface of the web 15 and joined to a common exposed contact surface 19 substantially parallel to the supporting web 15. In cross-section, the ribs 16–16' may be formed of various configurations when in the unassembled and thus unstressed condition such as illustrated in FIGS. 2 and 3 of the drawing. For example, the ribs 16–16' may be formed with a rectangular configuration as illustrated in the drawing or otherwise may define a cross-section representing the configuration of a trapezoid, etc.

Assembly of the disclosed base pieces B and B' is achieved by sandwiching the insulative member intermediate the joint bar J and rail base flange 3. In the embodiments as illustrated in the drawing, this involves locating the base piece B or B' within the throat defined by the joint bar inclined foot 5 and horizontal base 6 such that the outwardly directed contact surfaces 19 of the ribs 16 engage the undersurface 20 of the joint bar foot 5 and top surface 21 of the joint bar base 6 as shown in FIG. 1. Then, this described sub-assembly is slipped over the rail base flange 3 so that the contact surfaces 19 of the inwardly directed ribs 16' abut the inclined top surface 22 of the rail base flange 3 and the bottom surface 23 thereof, respectively. Upon the tightening of the joint bolts (not shown) the joint bars on either side of the rail sections will be drawn together until the joint bars are properly fully seated, at which point it will be understood that the space between the juxtaposed surfaces 22–23 of the rail base flange 3 and the surrounding joint bar is reduced with the resultant applied force being transmitted to the various contact surfaces 19 of the intermediate ribs 16–16' projecting from both surfaces of the webs of the upper arm 9 and lower arm 10 of the base piece. This action causes the mass of each of the captivated ribs 16–16' to be compressed and displaced toward the center of the underlying or intermediate webs 15. In view of the inherent resiliency of the composition of the entire base piece B or B' it will follow that the cross-sectional configuration of the ribs 16–16' will be altered. This results in the ribs being compressed and deformed while at the same time a portion of the displacing force being applied to the various ribs is absorbed by the underlying web 15 which itself is partially deformed. In the case of the base piece B, this latter deformation will be understood to be transmitted from any one rib on either side of each of the base piece arms 9 and 10 into the space provided by the groove 17 on the opposite side of the displaced rib 16 or 16'.

The above described action during use of the base piece B or B' according to the present invention results in superior retention of the base piece due to the filling in of irregularities between the rail and joint bar by the compressed and deformed ribs or serrations 16–16'. The resultant construction provides in effect a self-contained spring-loaded insulative base member with the plurality of ribs 16–16' having their contact surfaces 19 constantly biased against the juxtaposed metal surfaces of the adjacent joint bar and rail base flange such that the likelihood of migration of the base piece during subsequent travel over the insulated joint assembly A is greatly reduced.

I claim:

1. An insulated rail joint including, a pair of adjacent longitudinally aligned rail sections each having a web and a base flange, a joint bar provided with an upright disposed in laterally spaced-apart relationship adjacent said two rail webs and a foot disposed in vertically spaced-apart relationship adjacent said two rail flanges, an insulative base piece intermediate said joint bar foot and adjacent rail base flanges, said base piece of resilient deformable composition and including an integral central web extending throughout its lateral extent, a plurality of integral ribs projecting from opposite surfaces of said central web and engaging said joint foot and adjacent rail base flanges respectively, said ribs being parallel and oppositely disposed one another, said ribs extending longitudinally of said base piece, rail sections and joint bar, adjacent ones of said ribs well spaced laterally from one another to define a groove therebetween, and said base piece void of additional fastening means for immobilizing said base piece relative said joint bar and rail base flanges, whereby reduction of said space between said joint bar foot and adjacent rail base flanges during installation of said joint bar compresses and deforms said ribs to enhance retention of said base piece in said rail joint during travel thereover.

2. An insulated rail joint according to claim 1 wherein, said ribs define a substantially rectangular configuration in cross-section when not compressed.

3. An insulated rail joint according to claim 1 wherein, said base piece comprises a synthetic resinous composition.

4. An insulated rail joint according to claim 1 wherein, said joint bar includes a base beneath and spaced from said joint bar foot, said insulative base piece disposed between said foot and rail base flange comprising an upper arm, and said insulative base piece including a lower arm joined to said upper arm and disposed intermediate said rail base flange and said joint bar base.

5. An insulated rail joint according to claim 1 wherein, said ribs are equi-spaced from one another.

* * * * *